US005111664A

United States Patent [19]

Yang

[11] Patent Number: 5,111,664

[45] Date of Patent: May 12, 1992

[54] PORTABLE REFRIGERATING/HEATING APPARATUS

[75] Inventor: Kun M. Yang, Seoul, Rep. of Korea

[73] Assignee: SamSung Electronics Co., Ltd., Suwon, Rep. of Korea

[21] Appl. No.: 529,638

[22] Filed: May 29, 1990

[30] Foreign Application Priority Data

May 29, 1989 [KR] Rep. of Korea ..... 89-7187

[51] Int. Cl.[5] ..... F25B 21/02; F25D 17/04

[52] U.S. Cl. ..... 62/3.62; 62/457.9; 62/457.1; 62/408; 62/3.3

[58] Field of Search ..... 62/457.9, 3.3, 408, 62/409, 457.1, 3.62

[56] References Cited

U.S. PATENT DOCUMENTS

| | | | |
|---|---|---|---|
| 3,078,688 | 2/1963 | Petkwitz | 62/187 X |
| 4,019,339 | 4/1977 | Anderson | 62/457.9 X |
| 4,122,687 | 10/1978 | McKee | 62/187 X |
| 4,326,398 | 4/1982 | Brooks | 62/382 |
| 4,379,391 | 4/1983 | Rhee | 62/408 |
| 4,468,932 | 9/1984 | Bullard | 62/457.9 X |
| 4,723,418 | 2/1988 | Whitmer, II | 62/457.9 X |
| 4,732,014 | 3/1988 | Frohbieter | 62/382 |
| 4,823,554 | 4/1989 | Trachtenberg et al. | 62/3.3 |
| 4,845,957 | 7/1989 | Richardson | 62/457.9 X |

*Primary Examiner*—Albert J. Makay
*Assistant Examiner*—William C. Doerrler
*Attorney, Agent, or Firm*—Robert E. Bushnell

[57] ABSTRACT

A portable refrigerating/heating apparatus comprises a heat exchanging portion and a preserving portion, which assure the cooling state and the heating state of the foodstuff and are separable from each other, in which a preserving portion for storing the storage goods in its enclosed hollow space is removably placed on the upper surface of said heat exchanging portion provided with the heat exchanging member and the blowing member, the air heat-exchanged by the heat exchanging member is forcedly blown by the blowing member into the preserving portion while being discharged through the heat exchanging means therefrom to the outside so as to cool or heat the storage goods, and then the preserving portion is separated from the heat exchanging means to be portable.

10 Claims, 3 Drawing Sheets

PORTABLE REFRIGERATING/HEATING APPARATUS

BACKGROUND OF THE INVENTION

The invention is related to providing a portable refrigerating/heating apparatus for cooling or heating drink and foodstuff and then for keeping heat, and particularly to providing a portable refrigerating/heating apparatus including a foodstuff preserving portion and a heat exchanging portion, which is able to be separated from each other and to carry only the preserving portion.

Apparatus for refrigerating and/or heating the foodstuff have been developed and used in various manners. For example, a refrigerator is generally made in the form of the rectangular body, and in which the foodstuff preserving chamber is tightly enclosed and the heat exchanging portions are integrally merged in the peripheral wall of the foodstuff preserving chamber to be communicated with the foodstuff preserving chamber, so that the air in the foodstuff preserving chamber is heat-exchanged, and the heat-exchanged air generates the convection by the fan motor in the preserving chamber to cool the foodstuff.

Also, a heating apparatus is provided with the preserving chamber the same as in a refrigerator and includes a heater considered as the heat exchanging means for emitting a high heat, so that the air in the preserving chamber is heat-exchanged, and the heated air heats the foodstuff or the medicinal decoction, etc., or it directly heats the foodstuff to preserve them at the predetermined uniform temperature.

But, such like conventional apparatus have been used for only one purpose. For example, the refrigerating or the heating apparatus is fixedly installed in the kitchen of a home or a shop to store a large amount of stock as well as to take them out therefrom if necessary. It has been generally manufactured so that its volume is relatively bigger thereby setting importance on the preservation of a large amount of goods or foodstuff.

Then, nowadays it is requested to facilitate a small amount of the foodstuff to be cooled and/or heated and to transport it while being stored at the predetermined temperature. Further, its carrying and movement is preferable. Nevertheless it has not been developed until now except for storage houses made from insulative materials, for example, foam material, etc. to store the foodstuff under the heat insulation condition.

On the other hand, a conventional typical apparatus is disclosed in Japan Laid Open Patent Publication No. Sho 64-84083. A refrigerating/heating apparatus described in this Patent Publication includes an opening portion provided with an insulative window for viewing the storage goods; a Peltier element being automatically capable of changing the heat absorbing and the heat emitting according to the switching of the current polarity to be applied thereto; a heat exchanging portion including a heat absorbing plate and a heat sink plate junctioned to each other; and a vacuum vessel manufactured to lessen the wall thickness as well as to enhance the insulation. Whereby a heat exchanging portion absorbs the heat by the heat absorbing plate and emits the heat through the heat sink plate when the direct current is applied thereto. Herein it is known that this refrigerating/heating apparatus is centered on the application of the Peltier element.

Also, Japan Utility Model Publication No. Sho 61-1332 is disclosed relative to a heat exchanging apparatus including the storage house provided with the refrigerating parts, such as a wire condenser, a fan motor, etc., in which the fan is installed at the diagonal line of the mechanic chamber on four sides of which the air passages are formed, the compressor is mounted in a position below the blowing direction of the fan, the hot portion of the wire condenser connected to the compressor is arranged below the blowing direction and between the air passage formed as the discharging port and the compressor, while its cold portion is arranged over the blowing direction and the air passage formed as the intaking port and the fan, whereby the storage of the hot air in the mechanic chamber for performing the air intaking/discharging from its multi-directions is prevented, the speed for introducing/discharging the air from and/or into the mechanic chamber is somewhat relieved, the refrigeration parts are heat-exchanged to be cooled in order to create the low temperature, and the air is reversely blown against the refrigerating parts to increase the temperature gradually, thereby improving the heat radiation of the compressor and the heat exchanging of the wire condenser.

But, the cited reference is related to the improvement of the thermal efficiency in the freezing cycle, and it is adapted to use as a show case installed fixedly in a predetermined position of the shop, not as a portable refrigerator.

Considering the technical contents as described above, these types of appliances are not portable. Therefore, it is difficult to carry a conventional applicance since its mechanic chamber and the storage house in the refrigerator or the show case are not separated from each other.

SUMMARY OF THE INVENTION

On the other hand, it is possible to use the heat exchanging apparatuses of the appliance as described above, so that the lower portion is formed as the mechanic chamber for heating or cooling the foodstuff and the upper portion is formed as the storage house for keeping the temperature of the foodstuff, while the lower portion and the upper portion can be separated from each other to facilitate the carrying of only the storage house.

Thus, the object of the invention is to provide a portable refrigerating/heating apparatus for cooling/heating the storage goods as well as separating the preserving portion from the heat exchanging portion to be able to carry only the preserving portion easily.

The other object of the invention is related to providing a portable refrigerating/heating apparatus for cooling/heating the foodstuff by generating the convection in the preserving portion.

Another object of the invention is related to providing a portable refrigerating/heating apparatus for facilitating the control of each of the parts in the heat exchanging portion electrically.

The invention is provided with a preserving portion and a heat exchanging portion, which assure the cooling state and the heating state of the foodstuff and which are separated from each other, comprising a heating exchanging means including the heat exchanging member and the blowing member mounted properly therein with a coupling portion at its upper; a preserving means having a hollow storage chamber formed therein, the other coupling portion at its lower and the cover member along with the handle portion at its upper; and at least one opening/closing means for communicating said preserving means with said heat exchanging means, which are mounted in said preserving means.

On the other hand, the heat exchanging means is provided with means for detecting its coupling with said preserving means, and the preserving means is provided with temperature sensing means, so that they may be operated under the electrical control to selectively generate cooling air or heating air by the heat exchanging member according to the goods stored in said storage chamber, in which said heat exchanging member may be the Peltier element or the evaporator among parts of the evaporator, the compressor, the capillary tube, the fan and the condenser adapted to the refrigerating cycle. Also, said heat exchanging member and said blowing member are operated only when said heat exchanging means is coupled to said preserving means. Said preserving means includes an intaking member mounted at the center portion of its storage chamber to guide the heat exchanged air into said preserving case and at least two opening/closing members spaced away from said center portion, in which said intaking member is provided with a plurality of ventilating holes formed on its upper and an opening/closing member mounted at the inner center of its lower to communicate with said heat exchange means. All of said opening/closing members include a solenoid valve or a valve fabricated to be opened when said preserving means and said heat exchaning means are coupled with each other as described below in detail, so that it may be electrically connected with said heat exchanging means to facilitate its system control.

Also, according to the invention, it is easy to couple the preserving means with the heat exchanging means, the coupling portions of which are step shaped in configuration to engage against each other. At this time, means for detecting the coupling between the preserving means and the heat exchanging portion includes a lead switch or micro switch, and means for sensing the temperature in the preserving means including a thermistor, so that they may be electrically connected to parts of the heat exchanging means.

As described above, it is known that a preserving means for storing the storage goods in its enclosed hollow space is removably placed on the upper surface of the heat exchanging means provided with the heat exchanging member and the blowing member, the air heat-exchanged by the heat exchanging member is forcedly blown by the blowing member into the preserving means while being discharged through the heat exchanging means therefrom to the outside so as to cool or heat the storage goods, and then the preserving means is separated from the heat exchanging means to be portable.

BRIEF DESCRIPTION OF THE INVENTION

The invention will be described in detail with reference to the attaching drawings.

DETAIL DESCRIPTION OF THE INVENTION

Figure 1:
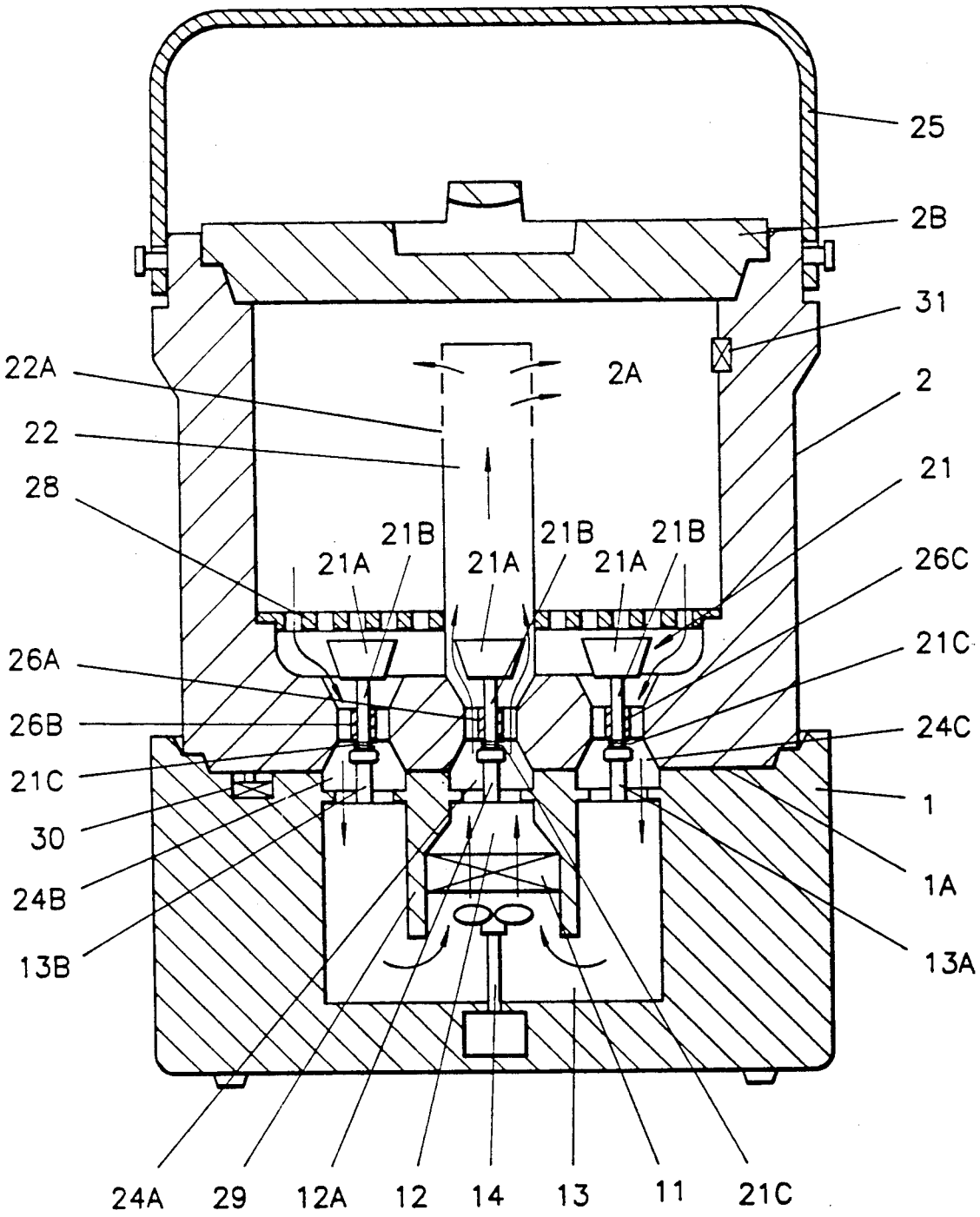
FIG. 1 is a detailed crosssectional view showing a preferred embodiment of a portable refrigerating/heating apparatus according to the invention.
Figure 2:
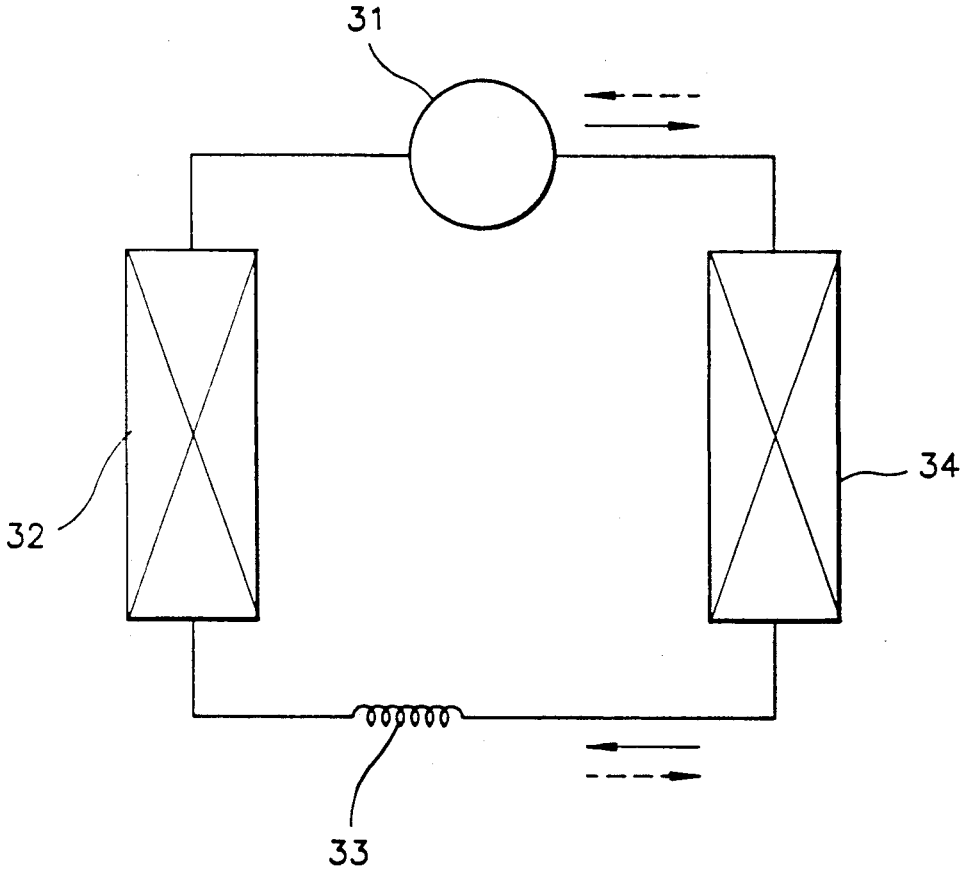
FIG. 2 (PRIOR ART)
FIG. 2 is a view illustrating a refrigeration cycle or a heat pumping cycle based on the prior art.
Figure 3:
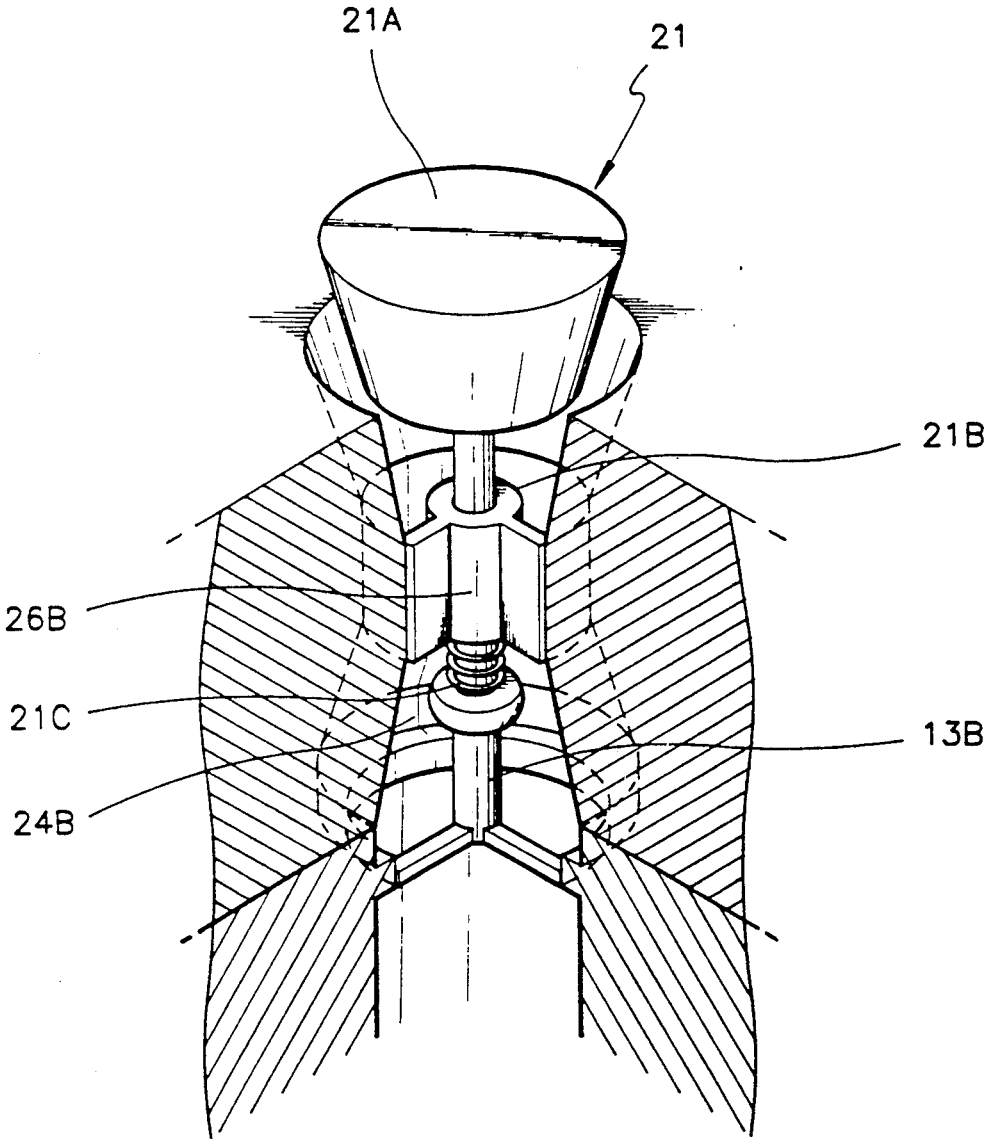
FIG. 3 is an enlarged view of valve 21 and its related parts.

FIG. 1 illustrates a portable refrigerating/heating apparatus for storing the foodstuff under the refrigerating condition or the heating condition. A portable refrigerating/heating apparatus is provided with heat exchanging case 1 and preserving case 2 which are removably coupled with each other.

Heat exchanging case 1 includes the portions for intaking/discharging the air from and/or into at least one of its sides and the evaporator, the compressor, the capillary tube and the condenser for the refrigerating cycle as not shown in the drawing. Heat exchanging member 11 includes a Peltier element or the evaporator. For example, the Peltier element can be provided with a heat absorbing plate and a heat radiating plate coupled therewith, and the evaporator may function to cool the foodstuff in the refrigerating cycle or to heat the foodstuff in the refrigerating reverse cycle.

Heat exchanging case 1 includes the mechanic chamber in the form of a rectangular body or a cylindrical body, heat exchanging member 11 is mounted in the center of a cylindrical or rectangular shaped projecting support member 29 to heat-exchange with the inner of preserving case 2 by the cooled air or the heated air generating therefrom, in which projecting support member 29 is fixed around the center upper of heat exchanging case 1, so that supplying passage 12 is formed at its upper to supply the heat exchanged air into preserving case 2, and guiding passage or collecting passage 13 is formed at its lower to intake the air heat-exchanged in heat exchanging case into preserving case 2 or the fresh air from the outside.

Blowing fan 14 is mounted on the bottom of heat exchanging case 1 directly under collecting passage 13 of heat exchanging member 11 to supply the heat-exchanged air by heat exchanging member 11 into preserving case 2, thereby generating the convection and discharging the air heat-exchanged with the foodstuff into heat exchanging case 1.

A plurality of supporting pins 12A, 13A, 13B are fixed on the upper of supplying passage 12 and around the circumference of supporting member 29, respectively, to open or close opening/closing members 21.

Shelf portion 1A is formed on the upper of heat exchanging case 1 in the form of at least one step shaped circumference to place preserving case 2 thereon. In case that shelf portion 1A has preserving case 2 to be placed thereon, it may be provided with the packing materials so that preserving case 2 is tightly fitted to heat exchanging case 1, thereby preventing it from shaking.

Lead switch 30 may be immersed in the upper of heat exchanging case 1 in order to detect the coupling of heat exchanging case 1 with preserving case 2.

Preserving case 2 includes the same body heat exchanging case 1, in which the body is made by a relatively superior insulative material, and is provided with storage chamber 2A having the hollow space formed therein and cover 2B placed removably at the upper of storage chamber 2A to open or close storage chamber 2A for storing/drawing the foodstuff.

Intaking member 22 is installed in the vertical arrangement on the center portion of storage chamber 2a to intake the air heat-exchanged by heat exchanging member 11. A plurality of ventilating hole 22A are formed on the upper wall around the circumference of intaking member 22 to supply the air from heat exchanging member 11 into preserving case 2. At this time, ventilating holes 22A may be preferably formed on both of its upper and lower of intaking member 22 to selectively promote the convection phenomena according to the cooling air or the hot air. Therefore, storage chamber 2A is supplied with the heat-exchanged air to cool or heat the foodstuff and may detect the indoor temperature using temperature sensing means 31, for example a thermistor mounted in its predetermined position.

A plurality of circulating passages 24A, 24B, 24C are formed below the lower of preserving case 2 to correspond to supplying passage 12 and collecting passages 13, in which supporting pins 12A, 13A, 13B are positioned, respectively, so that they allow storage chamber 2A to be communicated with supplying passage 12 and collecting passages 13. With it, the air heat-exchanged at heat exchanging member 11 is supplied through supplying passage 12, circulating passage 22A and intaking member by turn into storage chamber 2A. Subsequently, the air in storage chamber 2A is collected through both circulating passages 24B and 24C into collecting passage 13, in which the air is forcedly circulated in the convection type by means of blowing fan 14 to cool or heat storage chamber 2A. At this time, opening/closing members 21 mounted in each of circulating passages 24A, 24B, 24C are selectively opened or closed for the cooling or the heating of storage chamber 2A.

Opening/closing member 21 is a valve which is supported in the closing state by elastic member 21C during the separation of preserving case 2 from heat exchanging case 1 and is opened by supporting pins 12A, 13A, 13B during the coupling of preserving case 2 with heat exchanging case 1. As shown in FIG. 1, opening/closing member 21 is provided with head portion 21A, on the upper of which is integrally made in the form of the reverse truncated cone, and sliding rod 21B extended downward from head portion 21A. Sliding rods 21B are slidably inserted into sliding guide portions 26A, 26B, 26C formed at the center of each of circulating passages 24A, 24B, 24C to freely move upward and downward therein while being provided with elastic member 21C mounted elastically at its lower to support opening/closing member 21.

When preserving case 2 is placed on heat exchanging case 1, opening/closing member 21 is pushed upward by supporting pins 12A, 13A, 13B to open each of circulating passages 24A, 24B, 24C, so that the cooling air or the heating air is supplied into storage chamber 2A to heat-exchange the foodstuff. But, in order to effectively cool or heat the foodstuff in storage chamber 2A, supporting plate 28 is fixed at the predetermined height over opening/closing member 21 without disturbing the operation of opening/closing members 21 by the foodstuff. On the contrary, in case that preserving case 2 is separated from heat exchanging case 1 for its carrying, opening/closing member 21 is forcedly lowered by elastic members 21C to close circulating passages 24A, 24B, 24C as well as to keep heat in preserving chamber 2, thereby maintaining the foodstuff under the cooling condition or the heating condition.

Also, handle portion 25 is fixed on the upper of preserving case 2 to facilitate its carrying and movement.

As described above, the invention cools or heats the stored foodstuffs in preserving case 2 by the cooling air or heating air supplied from heat exchanging case 1 under the coupling of heat exchanging case 1 and preserving case 2. Next, in case that it is necessary to carry preserving case 2, preserving case 2 may be portably carried under the separation from heat exchanging case 1. Therefore, it is assured that its use is very convenient as well as being useful.

Furthermore, according to the invention, it is known that heat exchanging member 11 and blowing fan 14 may be electrically controlled according to detecting the coupling or the separation of heat exchanging case 1 and preserving case 2 by detecting member 30 as well as the maximum or minimum temperature of preserving chamber 2A by temperature sensing means 31. The detail explanation of such like operation control is omitted with since it may be easily realized based on the prior art.

Accordingly, the invention has the effect that the user can easily carry only the preserving case having the foodstuff stored therein in the cooling state or the heating state according to his preference as well as enjoy the inherent taste of the foodstuff.

What is claimed is:

1. A portable refrigerating/heating apparatus, including a Peltier heat exchanging unit, comprising:

a heat exchange case having an air supply passage, at least one air collecting passage, a plurality of support pins and a coupling detection switch, wherein said air supply passage is comprised of a support member having said heat exchanging unit mounted thereon;

a preserving case having a hollow storage chamber formed therein, coupling means for coupling said preserving case on top of said heat exchanging case, at least two air passages and at least two air passage opening/closing means connected to said air passages and a cover, wherein said at least two air passage opening/closing means align with said support pins for controlling said at least two passage opening/closing means to open when said preserving case is coupled to said heat exchanging case; and blower means for cycling air from said at least one air collecting passage, over said heat exchanging unit, through said air supply passage, into said storage chamber and back through said at least one air collecting passage.

2. The apparatus as claimed in claim 1, wherein said heat exchanging case comprises two air collecting passages and said blower means is centrally mounted in said heat exchanging case and centered below said heat exchanging unit.

3. The apparatus as claimed in claim 2, wherein said opening/closing means comprise a plurality of valves each comprising:

a valve head connected via a rod to an elastic means, wherein said elastic means causes said valve head to seat in said air passage of said preserving case for blocking passage of air into or out of said storage chamber when said preserving case is not coupled to said heat exchanging case.

4. The apparatus as claimed in claim 3, wherein said preserving case further comprises:

a plurality of porous supporting plates mounted in said storage chamber a predetermined distance from predetermined ones of said opening/closing means for keeping items stored in said storage chamber from interfering with the operation of said opening/closing means;

an intake means having an air passage centered above said supply passage, wherein said intake means includes a plurality of ventilating holes in the circumference thereof to supply air from said supply passage to said storage chamber; and a temperature sensor.

5. The apparatus as claimed in claim 1, further including a handle connected to said preserving case for enabling said apparatus to be carried.

6. A portable refrigerating/heating apparatus, including an evaporator as a heat exchanging unit, comprising:

a heat exchange case having an air supply passage, at least one air collecting passage, a plurality of support pins and a coupling detection switch, wherein said air supply passage is comprised of a support member having said heat exchanging unit mounted thereon;

a preserving case having a hollow storage chamber formed therein, coupling means for coupling said preserving case on top of said heat exchanging case, at least two air passages and at least two air passage opening/closing means connected to said air passages and a cover, wherein said at least two air passage opening/closing means align with said support pins for controlling said at least two passage opening/closing means to open when said preserving case is coupled to said heat exchanging case; and blower means for cycling air from said at least one air collecting passage, over said heat exchanging unit, through said air supply passage, into said storage chamber and back through said at least one air collecting passage.

7. The apparatus as claimed in claim 6, wherein said heat exchanging case comprises two air collecting passages and said blower means is centrally mounted in said heat exchanging case and centered below said heat exchanging unit.

8. The apparatus as claimed in claim 7, wherein said opening/closing means comprise a plurality of valves each comprising:

a valve head connected via a rod to an elastic means, wherein said elastic means causes said valve head to seat in said air passage of said preserving case for blocking passage of air into or out of said storage chamber when said preserving case is not coupled to said heat exchanging case.

9. The apparatus as claimed in claim 8, wherein said preserving case further comprises:

a plurality of permeable supporting plates mounted in said storage chamber a predetermined distance from predetermined ones of said opening/closing means for keeping items stored in said storage chamber from interfering with the operation of said opening/closing means;

an intake means, separating said storage chamber from another of said opening/closing means, having an air passage centered above said supply passage, wherein said intake means includes a plurality of ventilating holes in the circumference thereof to supply air from said supply passage to said storage chamber; and a temperature sensor.

10. The apparatus as claimed in claim 6, further including a handle connected to said preserving case for enabling said apparatus to be carried.

* * * * *

UNITED STATES PATENT AND TRADEMARK OFFICE

CERTIFICATE OF CORRECTION

PATENT NO. : 5,111,664
DATED : May 12, 1992
INVENTOR(S) : Kun-Mo YANG

It is certified that error appears in the above-indentified patent and that said Letters Patent is hereby corrected as shown below:

TITLE PAGE

Item: [75] Inventor: change "Kun M. Yang" to --Kun-Mo Yang--,

Column 1,

Line 44, before "foodstuff", delete "the",

Signed and Sealed this

Thirteenth Day of August, 1996

Bruce Lehman

*Attest:*

BRUCE LEHMAN

*Attesting Officer*

*Commissioner of Patents and Trademarks*